United States Patent [19]

Duarte

[11] Patent Number: 4,826,022

[45] Date of Patent: May 2, 1989

[54] DISPLAY PANEL ASSEMBLY

[75] Inventor: William S. Duarte, Seekonk, Mass.

[73] Assignee: Plastic Development, Inc., Pawtucket, R.I.

[21] Appl. No.: 183,921

[22] Filed: Apr. 20, 1988

[51] Int. Cl.[4] ..... A47F 7/00

[52] U.S. Cl. ..... 211/59.7; 211/94; 248/220.4

[58] Field of Search ..... 211/59.1, 57.1, 54.1, 211/94; 248/220.4, 220.3, 221.1; 24/3 J, 457

[56] References Cited

U.S. PATENT DOCUMENTS

| | | | |
|---|---|---|---|
| 1,781,991 | 11/1930 | Stover | 211/94 X |
| 2,695,105 | 11/1954 | Mitchell | 211/94 X |
| 3,515,284 | 6/1970 | Taylor | 211/94 X |
| 3,815,756 | 6/1974 | Cox | 211/57.1 |
| 4,094,415 | 6/1978 | Larson | 211/94 X |
| 4,678,151 | 7/1987 | Radek | 211/59.1 X |

*Primary Examiner*—Reinaldo P. Machado
*Assistant Examiner*—Sarah A. Lechok Eley
*Attorney, Agent, or Firm*—Salter & Michaelson

[57] ABSTRACT

A display panel assembly includes a display panel and a hanger element which is detachably securable in engagement on the display panel for supporting an article for display in front thereof. The display panel includes a front plate having a plurality of spaced horizontally extending slots therein and a retaining plate which is assembled on the rear side of the front plate and formed so that it defines a plurality of opposed notches adjacent the upper and lower edges of the slots. The hanger element includes an engagement portion which is receivable in engagement in a pair of the opposed notches in the retaining plate and a hanger portion which extends outwardly from the engagement portion in front of the display panel for supporting an article for display when the engagement portion is received in engagement in the notches.

7 Claims, 3 Drawing Sheets

DISPLAY PANEL ASSEMBLY

BACKGROUND AND SUMMARY OF THE INVENTION

The instant invention relates to display apparatus and more particularly to a display panel assembly for displaying articles for retail sale.

A variety of different types of display apparatus have been heretofore available for displaying articles for retail sale. For example, various types of pegboard assemblies comprising apertured panels and one or more hanger elements which are removably receivable in the apertures in the panels have been widely used for supporting articles in various displays. However, it has frequently been found that the hanger elements of assemblies of this type are prone to becoming inadvertently disengaged from the panels thereof; and, as a result, for practical reasons, pegboard type display assemblies have often been found to be unsatisfactory. Other types of display assemblies which have included panels having permanently mounted hanger elements thereon have also been heretofore available, but have been found to be less than satisfactory because they cannot be readily adapted to meet the needs of various specific applications.

The instant invention provides an effective display panel assembly which is both highly practical and readily adaptable to meet the needs of various specific applications. Specifically, the display panel assembly of the instant invention comprises a display panel and one or more hanger elements which are detachably securable to the display panel for suspending various articles therefrom. The display panel comprises a front plate preferably having a plurality of elongated substantially horizontally extending slots therein and upper and lower positioning means on the rear side of the front plate which define a plurality of opposed notches adjacent the upper and lower edges of the slots. The hanger element comprises an engagement portion which includes first and second diverging arms and a hanger portion which extends outwardly from the engagement portion. The engagement portion is formed so that the arms are receivable through one of the slots when they are positioned in substantially aligned relation therewith but not when they are positioned in substantially transverse relation to the slot, and the arms are adapted so that they are receivable in engagement in the notches defined by the upper and lower positioning means for retaining the engagement portion in a position wherein the arms are in substantially transverse relation to the slot adjacent the rear side of the front plate. The hanger element is further constructed so that when the arms are received in engagement in the notches defined by the upper and lower positioning means, the hanger portion extends outwardly beyond the front plate for receiving and supporting an item for display in front of the front plate. The engagement portion is preferably formed so that the arms are resiliently movable together to move them into engagement in the notches, and the upper and lower positioning means are preferably constructed so that the arms are moved together slightly as they are moved into engagement in the notches in order to retain the arms in engagement in the notches. Specifically, the notches defined by at least one of either the upper positioning means or the lower positioning means are preferably defined by a plurality of rounded shoulders so that as the arms are moved into engagement in the notches, at least one of the arms cams on the adjacent rounded shoulder in order to resiliently move the arms together. The engagement portion is preferably integrally formed so that it comprises an elongated base portion, first and second converging portions, which extend inwardly and together from the opposite ends of the base portion, and first and second arms which are connected to the first and second converging portions respectively and diverge outwardly therefrom in rearwardly spaced relation to the converging portions. When the engagement portion is constructed in this manner, the base portion and the converging portions cooperate to mount the arms so that the arms can be resiliently moved together slightly, and the hanger portion extends outwardly from the base portion. Further, when the engagement portion is received in assembled relation with the panel, the converging portions engage the front side of the front plate, and the arms engage the rear side of the front plate to more effectively secure the hanger element on the panel.

It has been found that the display panel assembly of the instant invention can be effectively utilized for displaying various articles, such as prepackaged jewelry items, for retail sale. In this regard, the arms of the engagement portion are effectively securable in the notches in the upper and lower positioning means for detachably retaining the hanger element on the display panel. Further, the hanger element can be easily repositioned on the panel by repositioning it in the same slot or by assembling it in a different slot in the front plate.

Accordingly, it is a primary object of the instant invention to provide an effective display panel assembly for use in connection with retail sales.

Another object of the instant invention is to provide an effective display panel assembly comprising a panel and a hanger element which is effectively detachably securable to the panel but nevertheless readily repositionable thereon to adapt the display panel assembly for various specific applications.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
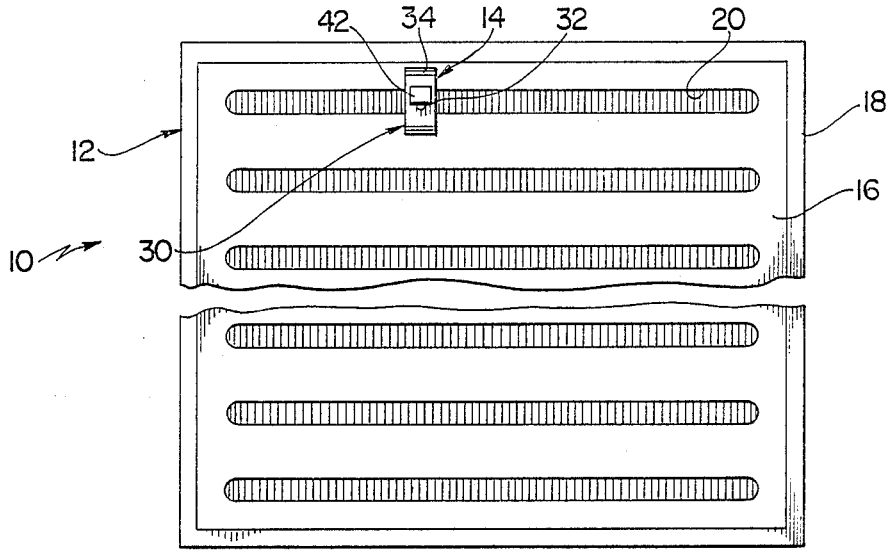
FIG. 1 is a fragmentary front elevational view of the display panel assembly of the instant invention.
Figure 6:
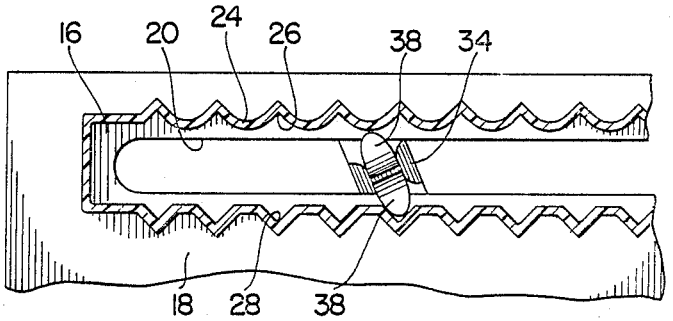
FIGS. 6 and 7 are sequential rear sectional views illustrating the assembly of the hanger element with the panel.
Figure 7:
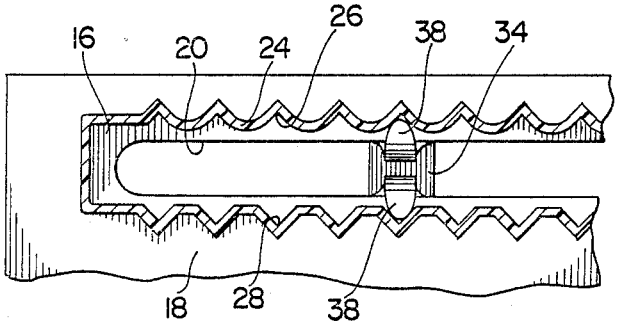

Referring now to the drawings, the display panel assembly of the instant invention is illustrated and generally indicated at 10 in FIGS. 1, 6 and 7, and it comprises a display panel generally indicated at 12 and a hanger element generally indicated at 14. As illustrated, the hanger element 14 is adapted to be detachably assembled on the display panel 12 for supporting and displaying articles in front thereof.

Figure 3:
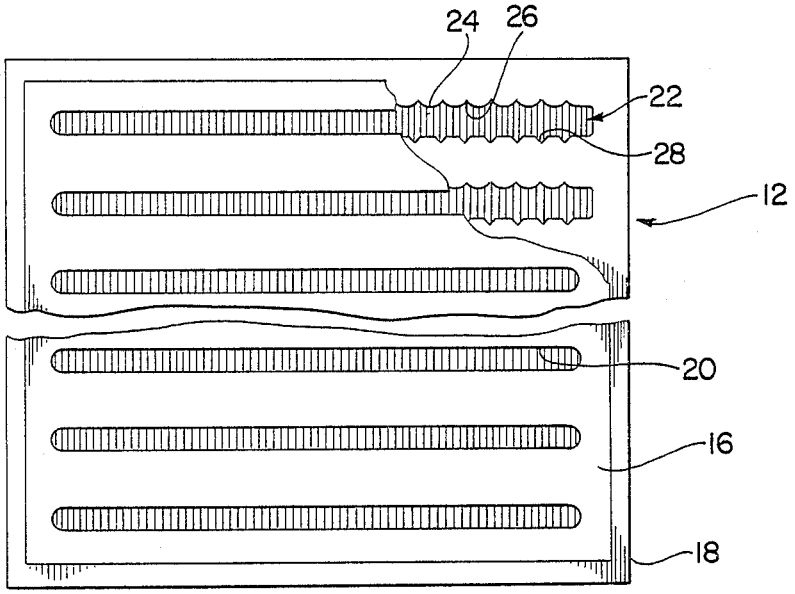
FIG. 3 is a front elevational view of the panel with portions of the front plate broken away.
Figure 2:
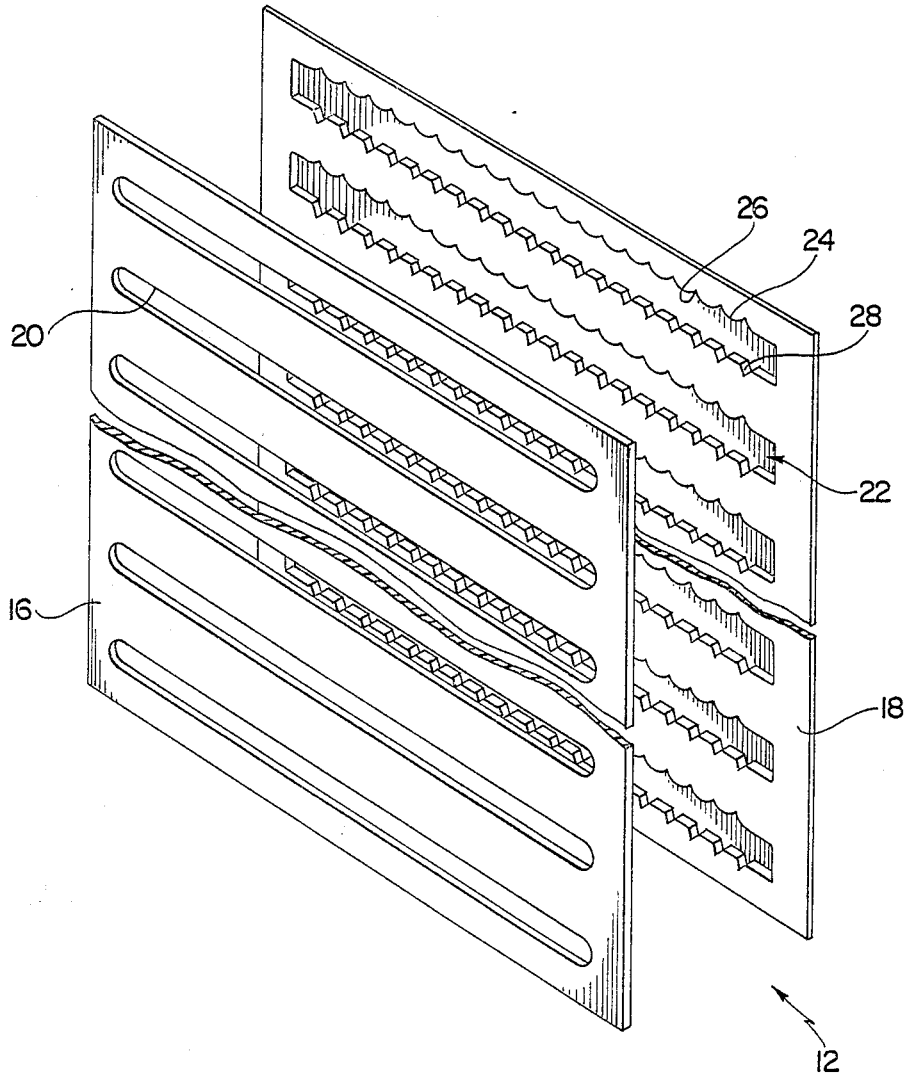
FIG. 2 is an exploded perspective view of the panel.

Referring first to FIGS. 1–3, the display panel 12 comprises a front plate 16 and a rear positioning plate 18. The front plate 16 is preferably integrally molded in a substantially flat configuration from a suitable rigid plastic, and it has a plurality of elongated, substantially horizontally extending spaced slots 20 formed therein. The positioning plate 18 is preferably also integrally molded from a suitable plastic material, and it has a plurality of spaced, substantially horizontally extending recessed tracks generally indicated at 22 formed therein. The upper edge of each of the tracks 22 is defined by a plurality of rounded shoulders 24 which define notches 26 therebetween, and the lower edge of each of the tracks 22 has a plurality of notches 28 formed therein which are substantially aligned with the notches 26. In assembled relation, the front plate 16 is secured in overlaying relation on the rear positioning plate 18, so that the tracks 22 are positioned in substantially aligned relation with the slots 20. Accordingly, the notches 26 and 28 are positioned along the upper and lower edges, respectively, of the slots 20 adjacent the rear side of the front plate 16.

Figure 4:
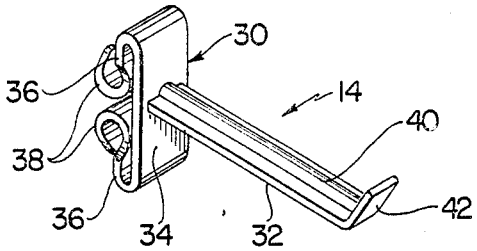
FIG. 4 is a perspective view of the hanger element.
Figure 5:
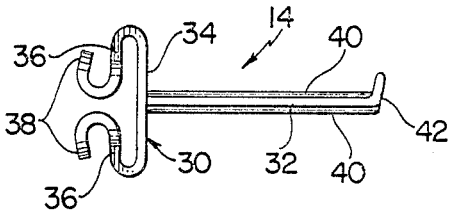
FIG. 5 is a side elevational view thereof.

Referring now to FIGS. 4 and 5, the hanger element 14 is more clearly illustrated. The hanger element 14 is preferably integrally molded from a suitable, rigid plastic material and it includes an engagement portion generally indicated at 30 and a hanger portion 32. The engagement portion 30 includes an elongated substantially vertically disposed base portion 34, a pair of converging portions 36 which converge from the upper and lower ends of the base portion 34 in slightly rearwardly spaced relation to the base portion 34, and a pair of arms 38 which diverge from the inner ends of the converging portions 36 in rearwardly spaced relation thereto, terminating in tapered rounded ends. The engagement portion 30 is formed so that the base portion 34 and the converging portions 36 cooperate to mount the arms 38 so that they are slightly resiliently movable together as the engagement portion 30 is assembled with the panel 12. The hanger portion 32 extends outwardly from the base portion 34, and it includes stiffening ribs 40 on the upper and lower sides thereof, and an upwardly extending retainer end portion 42 at the outer end thereof.

Referring now to FIGS. 6 and 7, the method of assembling the hanger element 14 with the panel 12 is illustrated. In this regard, the engagement portion 30 is assembled with the panel 12 by positioning the hanger element 14 so that the arms 38 are substantially aligned with one of the slots 20 and then passing the arms 38 rearwardly through the slot 20 so that they are received in the adjacent recessed track 22. The hanger element 14 is then rotated so that the lower arm 38 is positioned in engagement with one of the notches 28 adjacent the lower edge of the same slot 20, and so that the upper arm 38 engages one of the rounded shoulders 24 adjacent the upper edge of the slot 20. As the hanger element 14 is further rotated, the upper arm 38 cams on one of the rounded shoulders 24 so that the arms 38 are resiliently moved together, and finally the upper arm 38 passes into one of the notches 28 adjacent the upper edge of the slot 20 as illustrated in FIG. 7. Once the engagement portion 30 has been assembled in a pair of opposed notches 26 and 28, the arms 38 are retained in substantially transverse relation to the slot 20 and they can no longer pass outwardly therethrough. Further, the converging portions 36 engage the front side of the plate portion 16 adjacent the slot 20 to further prevent movement of the hanger element 14. Accordingly, once the hanger element 14 has been assembled in one of the slots 20 and the track 22 aligned therewith, the hanger element 14 is effectively detachably secured on the panel 12.

It is seen therefore that the instant invention provides an effective display panel assembly which is adapted for use in displaying various types of articles. The hanger element 14 can be effectively assembled at various positions on the panel 12, and it is effectively retained in position on the panel 12 by the cooperative engagement of the engagement portion 30 with the positioning plate 8. Accordingly, the display panel assembly 10 is readily adaptable for various specific applications, although the hanger element 14 is nevertheless effectively detachably securable on the panel 12 in a manner which enables it to be effectively utilized for supporting articles in front of the panel 12. Hence, for these reasons, as well as the other reasons hereinabove set forth, it is seen that the display panel assembly of the subject invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A display panel assembly comprising a display panel and a hanger element, said display panel comprising a front plate having upper and lower ends and front and rear sides and having an elongated, substantially horizontally extending slot therein and upper and lower positioning means defining a plurality of horizontally spaced pairs of opposed notches extending behind said plate adjacent the upper and lower edges of said slot, respectively, said hanger element comprising an engagement portion including first and second diverging arms and a hanger portion extending outwardly form said engagement portion, said arms being receivable through said slot when they are substantially aligned therewith but not when they are disposed in substantially transverse relation to said slot, said arms being receivable in engagement in a pair of said opposed notches for retaining said hanger element in a position wherein said arms are in substantially transverse relation to said slot and engage the rear side of said front plate and wherein said hanger portion extends outwardly beyond the front side of said front plate for receiving and supporting an item in front of said front plate.

2. In the display panel assembly of claim 1, said arms being resiliently movable together to move them into engagement in said notches.

3. In the display panel assembly of claim 2, said upper and lower positioning means being constructed so that said arms are moved slightly together as they are moved into engagement in said notches.

4. In the display panel assembly of claim 1, said engagement portion comprising an elongated base portion having opposite first and second ends and first and second converging portions which are integrally connected to the first and second ends of said base portion, respectively, and converge in rearwardly spaced relation to said base portion, respectively, said first and second arms being integrally connected to said first and second converging portions, respectively, and diverging therefrom in rearwardly spaced relation to said first and second converging portions, respectively.

5. In the display panel assembly of claim 4, said hanger portion extending outwardly from said base portion.

6. In the display panel assembly of claim 5, said converging portions engaging the front side of said front plate when said arms are received in said notches.

7. In the display panel assembly of claim 2, the notches defined by either said upper positioning means or said lower positioning means being defined by a plurality of rounded shoulders, one of said arms camming on one of said rounded shoulders to move said arms slightly together as they are moved into engagement in said notches.

* * * * *